United States Patent [19]

Eckberg, II

[11] 4,280,294

[45] Jul. 28, 1981

[54] UNIVERSAL SIGN

[75] Inventor: Keith S. Eckberg, II, St. Louis County, Mo.

[73] Assignee: Stout Industries, Inc., St. Louis, Mo.

[21] Appl. No.: 145,030

[22] Filed: Apr. 30, 1980

[51] Int. Cl.[3] ..... G09F 15/00

[52] U.S. Cl. ..... 40/606; 40/613

[58] Field of Search ..... 40/606, 607, 602, 613

[56] References Cited

U.S. PATENT DOCUMENTS

| | | | |
|---|---|---|---|
| 692,841 | 2/1902 | Fenton | 40/607 |
| 1,462,790 | 1/1923 | Fink | 40/606 |
| 2,454,648 | 11/1948 | Green | 40/602 |
| 4,095,360 | 1/1978 | Dinan | 40/613 |
| 4,214,393 | 7/1980 | Long | 40/613 |
| 4,248,001 | 2/1981 | Feuvray | 40/606 |

*Primary Examiner*—Gene Mancene

*Assistant Examiner*—Wenceslao J. Contreras

*Attorney, Agent, or Firm*—Kalish & Gilster

[57] ABSTRACT

A sign for universal mounting includes a display sheet and a frame surrounding said sheet, said frame being formed of a pair of U-shaped tubular members joined at the sides in butted relationship to provide joints at opposite sides of the sign. The sheet has rows of oppositely opening tabs or channel rails, etc. for receiving various panels with appropriate characters or numerals. The frame is apertured at top and bottom for securement thereto of channels which may be clamped to a post or vertical standard. The sides are similarly apertured for attachment of channels carrying pivot pins receivable by supports on opposite sides of the sign to pivotally mount the sign by said supports. A counterweight in the form of a channel is provided for securement by use of the aperture at the bottom of the sign for proper counterweighing of the sign when pivotally mounted.

17 Claims, 14 Drawing Figures

UNIVERSAL SIGN

BACKGROUND OF THE INVENTION

This invention relates to improvements in signs, and, more particularly, a sign of universal character.

It is often desired to make available signs of a commercial configuration which can be utilized for the display of many different types of goods and services so as to provide the user with a degree of flexibility in the manner in which the sign is to be presented. For example, in the case of signs utilized at service stations for displaying the price of motor fuel, or advertising other related goods or services, it may be desired to position the sign on the pavement in the general service area. Or it may be preferred to mount the sign in an elevated location such as above gasoline pumps, etc. or otherwise carried upon a standard. But a degree of difficulty is encountered in attempting to provide a sign which can be utilized in a variety of different ways while satisfying the various commercial display needs for which such signs are purchased.

SUMMARY OF THE INVENTION

It is an object of the present invention to provide an improved sign of universal character.

It is another object of the invention to provide such a sign which can be mounted in a variety of different ways and utilized for many different purposes, and which is an improvement upon the sign described and claimed in co-assigned Long U.S. application Ser. No. 967,243, non allowed.

It is yet another object of the invention to provide such a sign which can be mounted in a free-standing position upon an open surface, such as in the service area of gas stations, or on a floor, sidewalk, etc.

A further object of the invention is to provide such a sign which can be readily mounted upon a pole or other similar vertical standard.

A still further object of the invention is the provision of such a sign which allows the user to quickly and easily reconfigure the sign for being mounted in a variety of different ways.

Yet another object of the invention is to provide such a sign which, when mounted in a free-standing manner, is adapted to be pivotally carried whereby it may swing freely in response to being struck by objects or by the wind and the elements incident thereon, to prevent damage or injury.

It is yet another object of the invention to provide a sign of the character stated which is easily and simply manufactured and makes economical use of low cost, durable, long-lasting materials, being readily assembled without the use of highly skilled personnel.

Other objects and features will be in part apparent and in part pointed out hereinbelow.

DESCRIPTION OF THE PREFERRED EMBODIMENTS

Figure 1:
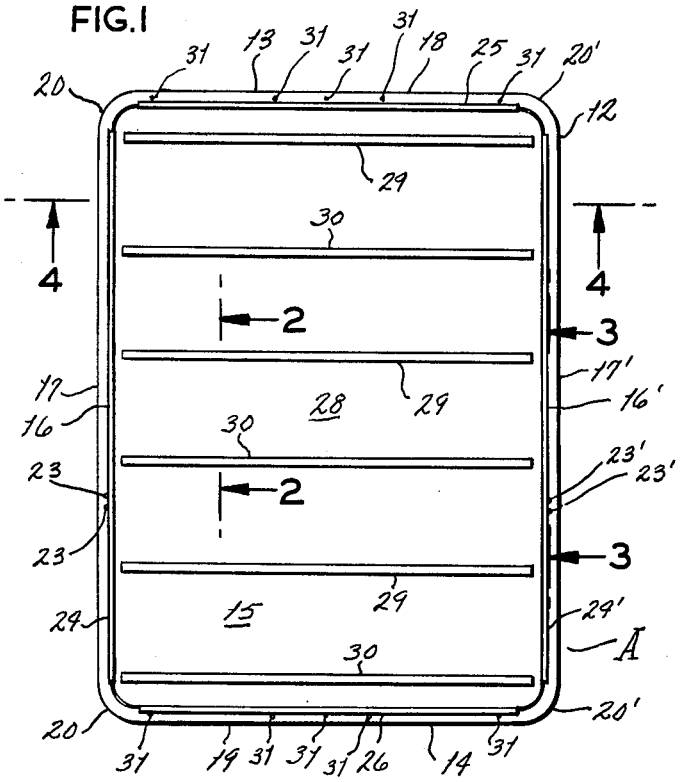
FIG. 1 is a front elevation of a sign constructed in accordance with and embodying the present invention.

Referring now to the drawings, the basic structure A of a sign configured in accordance with the present invention. Sign structure A comprises a frame 12 of generally rectangular shape, having somewhat greater height than width. Frame 12 is constituted by joined metal tubular upper and lower portions 13, 14, together carrying a metal display sheet 15 with said frame surrounding said sheet in effect. Frame portions 13, 14 are each formed, as by bending, into generally U-shaped configurations, being joined together at joints 16, 16' to define straight sides 17, 17' of the frame, and straight top and bottom portions 18, 19 of the frame, but with rounded corners, as at 20, 20'.

Figure 3:
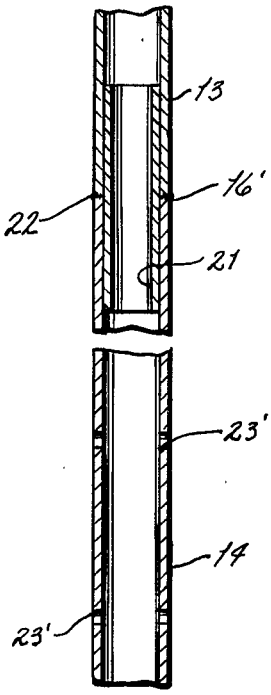
FIG. 3 is a vertical cross-section of a tubular member of the sign taken along line 3—3 of FIG. 1.
Figure 4:
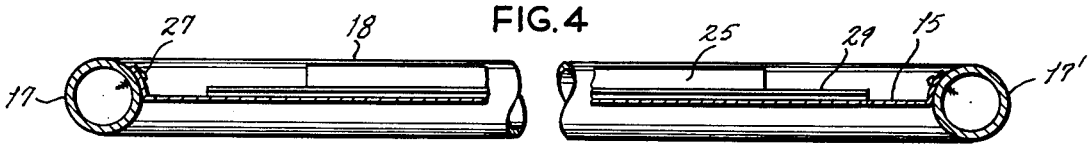
FIG. 4 is a horizontal cross-section of the sign taken along the line 4—4 of FIG. 1, with dimensions being exaggerated and portions of the sign broken away for convenience of illustration.

Joints 16, 16' are constituted by a butted relationship of the upper and lower frame portions 13, 14 as shown in FIG. 3 wherein it is seen that the respective ends of the upper and lower portions are butted together at the midpoint of the sign, a reduced diameter length of tubing, as at 21, is telescoped within the butted ends, which are then welded together, as at 22. Below said joints 16, 16', respective apertures 23, 23' are provided which extend transversely through the tubing of the lower frame portion 14.

Sheet 15, which may be of aluminum alloy, is carried within the inner periphery of frame 12. For this purpose, sheet 15 is provided with rounded flanges or lips 24, 24' along its side edges and 25, 26 along its respective upper and lower edges. Said lips are secured to the tubular frame 12 as by screws 27. Alternatively, sheet 15 may be riveted or welded in place, etc.

Figure 2:
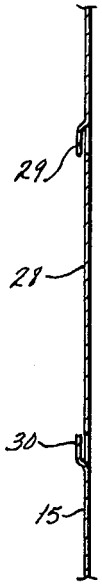
FIG. 2 is a vertical cross-section taken along line 2—2 of FIG. 1.

Sheet 15 can carry upon its face pairs of parallel, oppositely disposed tabs 29, 30 defined by lengths of material extending horizontally upon the face 28 of the sign and upset from the plane of the sheet. Each tab of a pair opens toward the other tab, as shown in FIG. 2, so that each tab pair 29, 30 may receive and secure upon face 28 panels (not shown) carrying various numerals, letters, characters, or other indicia. For example, the panels may display the price of motor fuel. Or they may display various legends such as will indicate goods or services offered by a place of business. There are three such pairs of tabs 29, 30 to display three lines of information. Various other panel mounting arrangements may be employed such as channel rails, screw studs, etc.

For purposes of mounting frame 12 in a preferred mode of sign construction, the upper and lower portions 18, 19 can each be provided with five apertures 31 which extend transversely through portions 18, 19 normal to the plane of sheet 15, these being in addition to the apertures 23, 23' below the joints 16, 16'.

Figure 5:
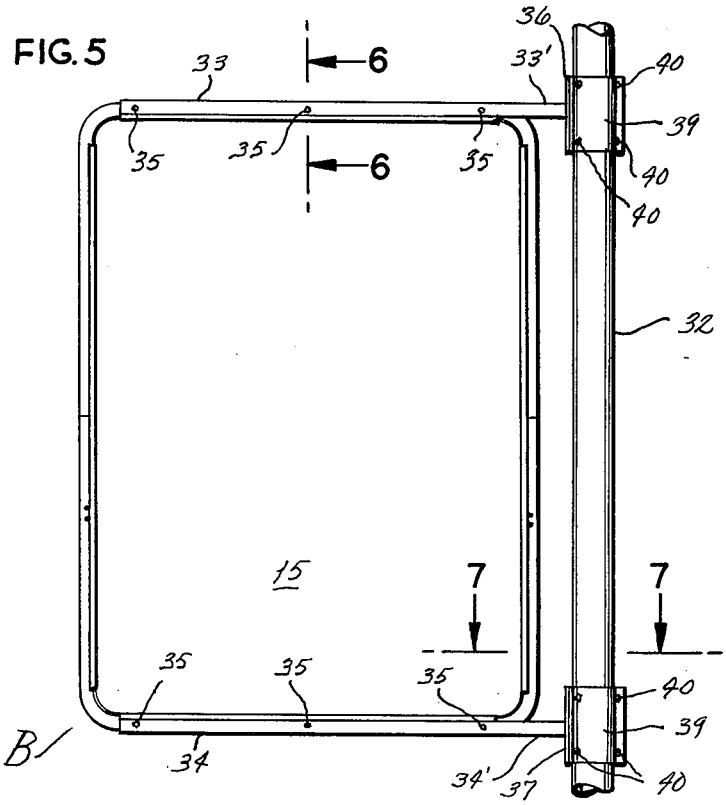
FIG. 5 is a front elevation of the sign FIG. 1 as configured for and mounted to a pole for extending outwardly therefrom.
Figure 6:
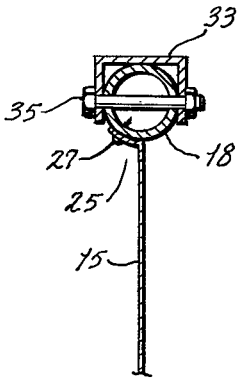
FIG. 6 is a vertical cross-section taken along lines 6—6 of FIG. 5, illustrating certain mounting features.

Referring to FIG. 5, the basic sign A is configured as a sign embodiment B which shown mounted to a pole or tubular standard 32 such as may already be present. For this purpose, sign A has secured along its lower and upper portions 18, 19 respective brackets 33, 34 of U-shaped cross-section, as seen in FIG. 6. Said brackets preferably have an inside width corresponding to the outside diameter of frame portions 18, 19 to fit tightly thereon, being secured by bolts 35 extending through apertures 31.

Figure 7:
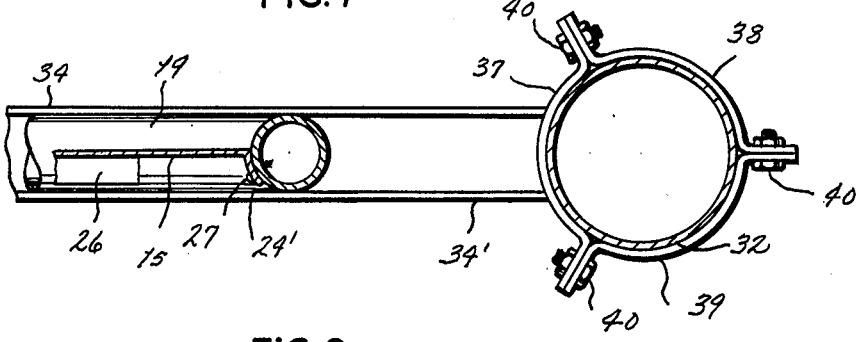
FIG. 7 is a horizontal cross-section of portions of the sign taken along line 7—7, and illustrating other features of mounting arrangement.

Each said channel 33, 34 extends beyond the right hand edge of the sign and carries at its respective outer end 33'–34' (as shown in FIG. 7) curved fittings 36, 37 confirming to the circular cross-section of standard 32. Similar curved fittings 38, 39 are provided which are bolted together by bolts 40 to clampingly surround standard 32. Thus, the channels 33, 34 are clamped to standard 32 at the top and bottom of the sign.

Figure 8:
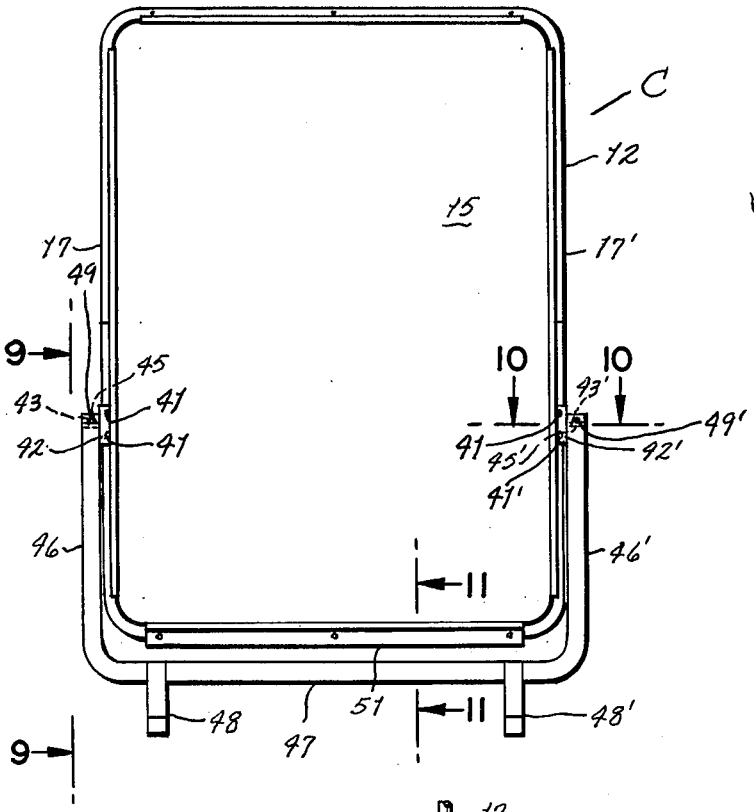
FIG. 8 is a front elevation of a sign of the invention as configured for and mounted in free-standing orientation.
Figure 10:
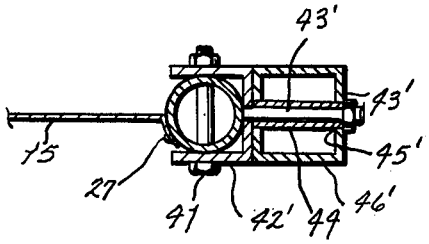
Fig. 10 is a horizontal cross-section taken along line 10—10 of FIG. 8. illustrating certain mounting features.
Figure 9:
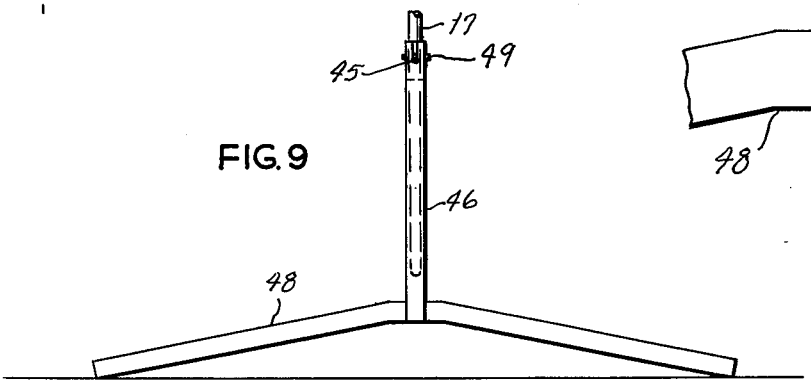
FIG. 9 is a fragmentary side elevation of one support arrangement for the sign, and illustrating portions of the sign, as taken along line 9—9 of FIG. 8.

FIG. 8 demonstrates another embodiment C of the sign made possible by alternative securement of frame 12. Such entails the bolting securement by bolts 41, 41' below joints 16, 16' of short channels, 42, 42' which said bolts 41, 41' are placed through apertures 23, 23' for this purpose. Said channels are of U-shaped cross-section, opening toward sheet 15. Each said channel carries an end threaded pin or stud 43, 43' which projects perpendicularly and laterally outwardly from the channel bracket for serving as a pivot. For this purpose, each pivot pin 43, 43' is received within a respective transverse slot 45, 45' (FIG. 9), located in the upper end of a respective support 46, 46' located at the opposite sides of the respective frame portion 17, 17' and so constituted by upright portions of a member 47 of U-shaped configuration which conforms to the shape of frame lower part 14. Said supports 46, 46' are of tubular steel, as shown in FIG. 10. Extending the width thereof are bushings, as at 44, in which the respective pivot pin may freely rotate. Preferably such bushings 44 are fitted within slots and retained therein by cross-pins or bolts 49, 49' extending through the upper end of supports 46, 46'.

Said member 47 is supported by pairs of legs 48, 48' which extend outwardly from the sign in opposite directions to provide a broad, stable base for the sign. Member 47 and legs 48, 48' may, for example, be of steel tubing of square cross-section.

Figure 11:
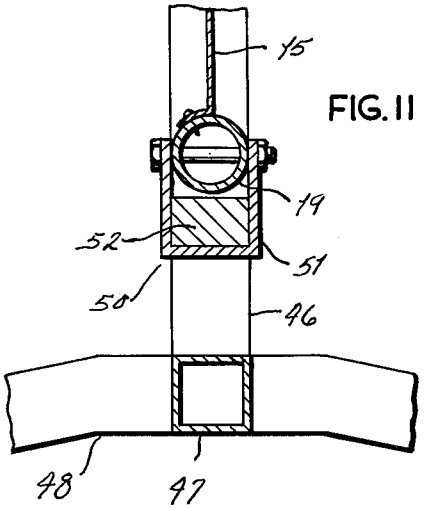
FIG. 11 is a vertical cross-section taken along line 11—11 of FIG. 8 and illustrating certain mounting features and a counter balance arrangement of the sign.

For maintaining sign panel 15 in upright disposition, a counterweight 50 is bolted to the lower edge tubular member 19, as shown in FIG. 11. Counterweight 50 is constituted by a channel member 51 considerably greater depth than the diameter of frame member 14 to provide a space within the channel member for a heavy bar 52, such as of steel.

Accordingly, frame 12 of embodiment C is free to swing on pivot pins 43, 43' in response to being struck, as by a person or vehicle, without causing substantial damage to the striking instrumentality or to the sign frame 12 or panel 15. Further, since the cross-sectional area of panel 15 above the pivot axis is considerably greater than that below the pivot axis, wind striking the panel 15 will merely cause frame 12 to pivot harmlessly, without causing the entire sign C with its frame 47 to be blown over.

Figure 12:
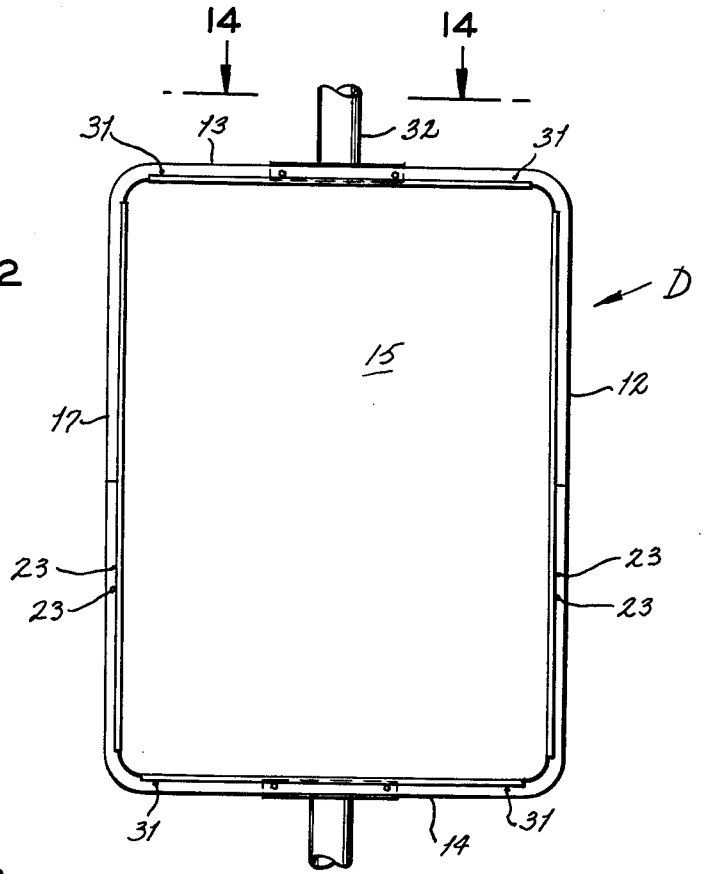
FIG. 12 is a front elevation of a sign of the invention as configured for and mounted to a pole in closely adjacent centered relationship to the pole.
Figure 13:
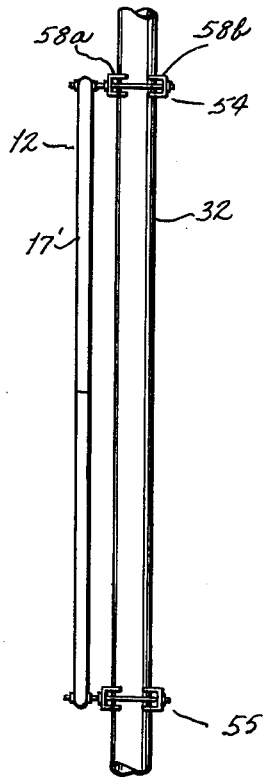
FIG. 13 is a side elevation of the sign arrangment of FIG. 12.
Figure 14:
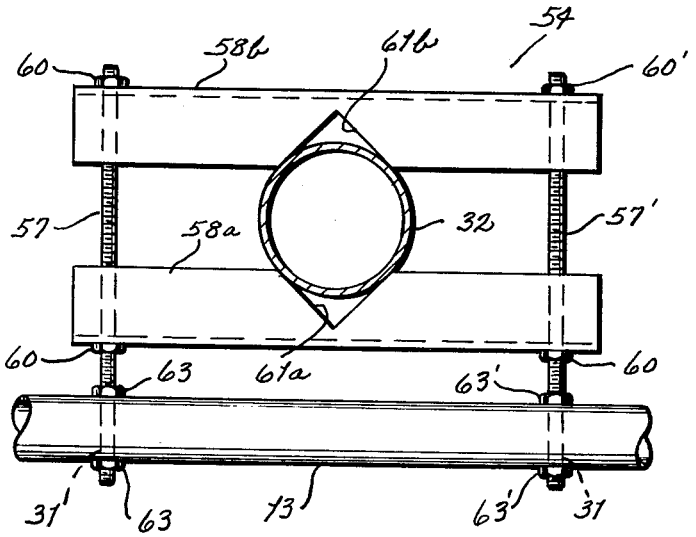
FIG. 14 is a horizontal cross-section of portions of the sign of FIG. 12, illustrating certain mounting features.

Referring now to FIGS. 12–14, indicated at D is an embodiment of the sign wherein the basic sign A is shown mounted to a pole or other tubular standard 32 of pre-existing type. Although pole 32 is of circular cross-section, it may be rectangular, ellipsoidal, or of other common cross-section. Pole 32 may be several inches in diameter. In embodiment D, sign panel 15 is affixed to pole 32 in such a way that the sign is centered with respect to the pole, and lies in a plane parallel to and adjacent the longitudinal, or vertical, axis of the pole.

For securement to the pole, there is affixed to the frame 12 of the sign at its top and bottom respective bracket clamps 54, 55.

Each said clamp 54, 55 is of the configuration shown for clamp 54 in FIG. 14. There, the upper frame member 13 has provided through two of its apertures 31 a respective threaded rod 57, 57'. Said threaded rods extend through the opposite ends of each of a pair clamp brackets **58*a*, 58*b* each of which is of U-shaped cross-section, as seen more clearly in FIG. 13. As will be apparent, apertures are provided at the opposite ends of each of these brackets members for receiving the threaded studs 57, 57' and with the channels or recesses of said channel members opening toward one another for clampingly receiving tube 32 therebetween. Nuts, as at 60, 60' are provided at opposite sides of the bracket members 58*a*, 58*b* for causing compression of these bracket members toward one another for tight engagement of the vertical posts 32. For enhancing the gripping engagement of the latter, each of bracket members 58*a*, 58*b* is provided also with a V-shaped recess in its flanges as at 61*a*, 61*b* thereby to provide a tooth-like sharp edged series of surfaces for bittingly engaging the periphery of the post or tube 32** to more securely clamp the brackets in position.

In a preferred manner of installation, the threaded members can be dispositioned within the brackets to a desired outward extension of the threaded studs for allowing sign frame 12 to be placed at a desired spacing outwardly from the post 32. The upper and lower frame members respectively, of the sign frame 12 are clampingly engaged to these threaded studs by nuts tightened in opposition, as indicated at 63, 63'.

Manifestly, the same frame 12 is utilized to construct the basic sign embodiment A, the pole or standard-mounted embodiment B, the pivoted free-standing sign embodiment C, as well as the pole-centered embodiment D, all without altering the fundamental frame structure, yet conducing to simple, speedy alteration of the mounting configuration by even relatively unskilled persons. Further, manufacture of frame 12 contemplates merely the forming of two frame elements 13, 14, which may be simply of economical steel tubing, into required U-shaped configurations and with simple joinder thereof at joints 16, 16' so that the frame 12 is self-supporting and ready for having panel 15 secured to it. Thereafter, the desired attachment mode, as for either embodiment B, C, or D, is easily realized by the mounting of the desired complementarily-shaped brackets 33, 34 or 42, 42', or as desired, to the universal frame 12.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed and desired to be secured by Letters Patent is:

1. A sign of universal mounting character for carrying a display, said sign comprising a display sheet, a frame having a plurality of components defining top and bottom and side portions of said frame, said components being joined together at joints at the sides of said frame, means associated with said joints for mounting said frame in a first display configuration, means respectively associated with said top and bottom portions for mounting said frame in a second display configuration, and means for securing said sheet to said frame.

2. A sign according to claim 1 and further characterized by said frame components comprising tubular upper and lower components joined together at joints on opposite sides of said frame.

3. A sign according to claim 2 wherein each of said upper and lower frame components are of U-shaped configuration.

4. A sign according to claim 3 wherein each of said upper and lower components is formed of a single length of metal tubing, said components when joined defining a generally rectangular shape with rounded corners.

5. A sign according to claim 4 wherein said joints are each defining by butted portions of said components, said means for mounting said frame in a first configuration comprising a pair of brackets for attachment to said telescoped portions, pivot pins carried by said brackets extending outwardly on opposite sides of said frame and support means for supporting said pivot means, said support means defining a base for said sign, said sign being pivotal upon said pins with respect to said base.

6. A sign according to claim 5 wherein said joints are located along the vertical center of said sign, said pivot pins defining a pivot axis across and transecting said sheet and located below said vertical center, the area of said pivot axis being greater than the area of said sheet below said pivot axis, and counterweight means secured to said bottom frame portion.

7. A sign according to claim 5 wherein said brackets comprise respective channel members of U-shaped cross-section each having a recess for receiving a respective one of the frame side portions, the recesses opening toward one another, at least one aperture extending transversely through each said channel member and each of said frame side portions, and fastener means extending therethrough.

8. A sign according to claim 5, said means for mounting said sign in a second display configuration comprising upper and lower brackets for attachment to said top and bottom frame portions, respectively, said brackets having frame remote portions extending outwardly from one side of said frame, and means carried by said frame remote portions for clampingly engaging a vertical standard.

9. A sign according to claim 8 wherein said upper and lower brackets comprise respective channel members of U-shaped cross-section, each having a recess for receiving the respective top or bottom frame portion, the recesses opening toward one another, at least one aperture extending transversely through each said channel member and through the respective top and bottom frame portions, and fastener means extending therethrough.

10. A sign according to claim 4 wherein said sheet is of metal and has lips formed along edges thereof, said lips being affixed to said upper and lower frame components at an inner periphery of said frame defined by said components.

11. A sign according to claim 10, said sheet comprising a plurality of tab-like elements formed by upset portions of said sheet, said elements being arranged in at least a pair of rows in oppositely disposed relationship with elements of one row opening toward elements of another row for receiving display panels.

12. A sign according to claim 5, said means for mounting said sign in a second display configuration comprising upper and lower clamping means for attachment to said top and bottom frame portions, respectively, each of said upper and lower clamping means each comprising a pair of bracket members for gripping, clamping engagement of a vertical standard, and elongated threaded members for mutually engaging the first and second bracket members to a corresponding one of said upper and lower frame members.

13. A sign according to claim 12, said frame including a plurality of apertures extending through each of said top and bottom frame members for receiving said threaded members.

14. A sign according to claim 13, said plurality of apertures being horizontally symmetrically located with respect to the center of said sheet, said upper and lower clamping means each being oriented for spanning said apertures thereby for clampingly engaging said vertical standard with said sheet centered with respect thereto.

15. A sign according to claim 14, each of said bracket members comprising a length of material having a U-shaped cross-section to define flanges and a recess therebetween, the recesses of the bracket members of each pair opening toward one another; each of said flanges having recess formed therein for receiving the surface of said vertical standard.

16. A sign according to claim 2, said joints each being defined by said upper and lower members butted together and fitted together in telescoped relationship over respective lengths of tubing.

17. A sign according to claim 16, said upper and lower members each comprising tubing of circular cross-section having a first diameter, said further lengths of material being of smaller diameter, said butted together members being welded one to another.

* * * * *